US007958594B2

(12) United States Patent
Cunningham

(10) Patent No.: US 7,958,594 B2
(45) Date of Patent: Jun. 14, 2011

(54) CENTRAL VACUUM CLEANER CROSS-CONTROLS

(75) Inventor: J. Vern Cunningham, Aurora (CA)

(73) Assignee: Cube Investments Limited, Aurora (CA)

( * ) Notice: Subject to any disclaimer, the term of this patent is extended or adjusted under 35 U.S.C. 154(b) by 1209 days.

(21) Appl. No.: 11/543,954

(22) Filed: Oct. 6, 2006

(65) Prior Publication Data

US 2007/0079467 A1 Apr. 12, 2007

Related U.S. Application Data

(60) Provisional application No. 60/784,770, filed on Mar. 23, 2006, provisional application No. 60/724,290, filed on Oct. 7, 2005, provisional application No. 60/777,528, filed on Mar. 1, 2006.

(51) Int. Cl.
*A47L 5/38* (2006.01)

(52) U.S. Cl. ..... 15/301; 15/319; 15/339

(58) Field of Classification Search ..... 15/301, 15/319, 339; *A47L 5/38*
See application file for complete search history.

(56) References Cited

U.S. PATENT DOCUMENTS

| | | | |
|---|---|---|---|
| 1,601,531 | A | 9/1926 | Jeannin |
| 1,883,288 | A | 10/1932 | Zubaty |
| 3,088,484 | A | 5/1963 | Marsh |
| 3,357,039 | A | 12/1967 | Hayward |
| 3,382,524 | A | 5/1968 | Sandstrom |
| 3,477,689 | A | 11/1969 | Berghoefer |
| 3,483,503 | A | 12/1969 | Pardiso |
| 3,565,103 | A | 2/1971 | Maselek |
| 3,570,809 | A | 3/1971 | Stuy |
| 3,626,545 | A | 12/1971 | Sparrow |
| 3,628,769 | A | 12/1971 | Lee |
| 3,661,356 | A | 5/1972 | Tucker |
| 3,663,845 | A | 5/1972 | Apstein |
| 3,676,986 | A | 7/1972 | Reiling |
| 3,826,464 | A | 7/1974 | Berghofer |
| 3,855,665 | A | 12/1974 | Schwartz |
| 3,965,526 | A | 6/1976 | Doubleday |

(Continued)

FOREIGN PATENT DOCUMENTS

| | | |
|---|---|---|
| EP | 0192469 | 8/1986 |

(Continued)

OTHER PUBLICATIONS

Gale Group, New Central Vacuum Breaks Home Automation Barrier, Feb. 26, 2002, http://www.findarticles.com/cf dls/m0EIN/2002 Feb26/83293317/p1/article.html.

(Continued)

*Primary Examiner* — David A Redding
(74) *Attorney, Agent, or Firm* — Dowell & Dowell, P.C.

(57) ABSTRACT

A vacuum cleaning system for use in a structure. System has receiver adapted to receive communication that an appliance has been activated, and a control circuit adapted to control the central vacuum cleaning system upon receipt of a communication at the receiver that the appliance has been activated. Example appliances include doorbell, telephone or ERV. System may have a communication module that communicates with corresponding appliance communication module. The system communication module may transmit communications to the appliance communication module. Alternatively, the appliance communication module may transmit communications to the system communications module. The modules may both receive and transmit. Preferably, communications between modules are radio frequency (RF) wireless, however wired communications, where wiring is possible or available, are also suitable.

12 Claims, 12 Drawing Sheets

U.S. PATENT DOCUMENTS

| | | | |
|---|---|---|---|
| 3,989,311 | A | 11/1976 | Debrey |
| 4,056,334 | A | 11/1977 | Fortune |
| 4,070,586 | A | 1/1978 | Breslin |
| 4,111,615 | A | 9/1978 | Watanabe |
| 4,114,557 | A | 9/1978 | De Brey |
| 4,175,892 | A | 11/1979 | De Brey |
| 4,225,272 | A | 9/1980 | Palmovist |
| 4,227,258 | A | 10/1980 | Root et al. |
| 4,246,675 | A | 1/1981 | Costanzo |
| 4,300,262 | A | 11/1981 | Rodowsky, Jr. et al. |
| 4,336,427 | A | 6/1982 | Lindsay |
| 4,368,348 | A | 1/1983 | Eichelberger et al. |
| 4,369,543 | A | 1/1983 | Chen et al. |
| 4,370,776 | A | 2/1983 | Kullik |
| 4,443,906 | A | 4/1984 | Tucker et al. |
| 4,473,923 | A | 10/1984 | Neroni et al. |
| 4,490,575 | A | 12/1984 | Kutnyak |
| 4,494,270 | A | 1/1985 | Ritzau et al. |
| 4,513,469 | A | 4/1985 | Godfrey et al. |
| 4,531,796 | A | 7/1985 | Gansert et al. |
| 4,536,674 | A | 8/1985 | Schmidt |
| 4,591,368 | A | 5/1986 | MacDuff |
| 4,611,365 | A | 9/1986 | Komatsu et al. |
| 4,654,924 | A | 4/1987 | Getz et al. |
| 4,664,457 | A | 5/1987 | Suchy |
| 4,680,827 | A | 7/1987 | Hummel |
| 4,683,515 | A | 7/1987 | Beihoff et al. |
| 4,688,596 | A | 8/1987 | Liebmann et al. |
| 4,693,324 | A | 9/1987 | Choiniere et al. |
| 4,731,545 | A | 3/1988 | Lerner et al. |
| 4,757,574 | A | 7/1988 | Sumerau |
| 4,766,628 | A | 8/1988 | Walker |
| 4,791,700 | A | 12/1988 | Bigley et al. |
| 4,829,625 | A | 5/1989 | Wang |
| 4,829,626 | A | 5/1989 | Harkonen et al. |
| 4,854,887 | A | 8/1989 | Blandin |
| 4,881,909 | A | 11/1989 | Blackman |
| 4,883,982 | A | 11/1989 | Forbes et al. |
| D315,043 | S | 2/1991 | Hayden |
| 4,991,253 | A | 2/1991 | Rechsteiner |
| 5,033,151 | A | 7/1991 | Kraft et al. |
| 5,067,394 | A | 11/1991 | Cavallero |
| 5,068,555 | A | 11/1991 | Oberdorfer-Bogel |
| 5,107,565 | A | 4/1992 | Chun |
| 5,109,568 | A | 5/1992 | Rohn et al. |
| 5,111,841 | A | 5/1992 | Houston |
| 5,120,983 | A | 6/1992 | Samaan |
| 5,125,125 | A | 6/1992 | Barsacq |
| D333,023 | S | 2/1993 | Herron, Jr. |
| 5,185,705 | A | 2/1993 | Farrington |
| D334,447 | S | 3/1993 | Rohn |
| 5,191,673 | A | 3/1993 | Damizet |
| 5,207,498 | A | 5/1993 | Lawrence et al. |
| 5,244,409 | A | 9/1993 | Guss et al. |
| 5,255,409 | A | 10/1993 | Fujiwara et al. |
| 5,263,502 | A | 11/1993 | Dick |
| 5,265,305 | A | 11/1993 | Kraft et al. |
| 5,274,578 | A | 12/1993 | Noeth et al. |
| 5,274,878 | A | 1/1994 | Radabaugh et al. |
| 5,276,939 | A | 1/1994 | Uenishi |
| 5,277,468 | A | 1/1994 | Blatt et al. |
| 5,298,821 | A | 3/1994 | Michel |
| 5,301,385 | A | 4/1994 | Abe et al. |
| 5,311,639 | A | 5/1994 | Boshler |
| 5,343,590 | A | 9/1994 | Radabaugh |
| 5,347,186 | A | 9/1994 | Konotchick |
| 5,349,146 | A | 9/1994 | Radabaugh |
| 5,353,468 | A | 10/1994 | Yap et al. |
| 5,363,534 | A | 11/1994 | Dekker et al. |
| 5,379,796 | A | 1/1995 | Wang |
| 5,391,064 | A | 2/1995 | Lopez |
| 5,404,612 | A | 4/1995 | Ishikawa |
| 5,409,398 | A | 4/1995 | Chadbourne et al. |
| 5,448,827 | A | 9/1995 | Ward |
| D364,014 | S | 11/1995 | Langeland et al. |
| 5,479,676 | A | 1/1996 | Martin et al. |
| 5,504,971 | A | 4/1996 | McCormick |
| 5,512,883 | A | 4/1996 | Lane, Jr. |
| 5,515,572 | A | 5/1996 | Hoekstra et al. |
| 5,525,842 | A | 6/1996 | Leininger |
| 5,542,146 | A | 8/1996 | Hoekstra et al. |
| 5,554,049 | A | 9/1996 | Reynolds |
| 5,560,076 | A | 10/1996 | Leung |
| 5,568,374 | A | 10/1996 | Lindeboom et al. |
| 5,572,767 | A | 11/1996 | Ishikawa |
| 5,578,795 | A | 11/1996 | Ward |
| 5,606,767 | A | 3/1997 | Crienjak et al. |
| 5,655,884 | A | 8/1997 | Rose |
| 5,698,957 | A | 12/1997 | Sowada |
| 5,713,656 | A | 2/1998 | Lin |
| 5,722,110 | A | 3/1998 | McIntyre et al. |
| 5,737,797 | A | 4/1998 | Rittmueller et al. |
| 5,737,798 | A | 4/1998 | Moren et al. |
| 5,740,581 | A | 4/1998 | Harrelson, II |
| 5,740,582 | A | 4/1998 | Harrelson, II |
| 5,747,973 | A | 5/1998 | Robitaille et al. |
| 5,753,989 | A | 5/1998 | Syverson et al. |
| 5,813,085 | A | 9/1998 | Fritz et al. |
| 5,815,883 | A | 10/1998 | Stein et al. |
| 5,815,884 | A | 10/1998 | Imamura et al. |
| 5,816,685 | A | 10/1998 | Hou |
| 5,850,665 | A | 12/1998 | Bousset |
| 5,871,152 | A | 2/1999 | Saney |
| D406,422 | S | 3/1999 | Burchard et al. |
| 5,893,194 | A | 4/1999 | Karmel |
| 5,896,618 | A | 4/1999 | Woo et al. |
| 5,917,428 | A | 6/1999 | Discenzo et al. |
| 5,918,728 | A | 7/1999 | Syverson |
| 5,924,163 | A | 7/1999 | Burns, Jr. |
| 5,924,164 | A | 7/1999 | Lindsay, Jr. |
| 5,926,908 | A | 7/1999 | Lindsay, Jr. |
| 5,926,909 | A | 7/1999 | McGee |
| 5,938,061 | A | 8/1999 | Ward et al. |
| 5,945,749 | A | 8/1999 | Li |
| 5,983,443 | A | 11/1999 | Redding |
| 5,987,697 | A | 11/1999 | Song et al. |
| 6,011,334 | A | 1/2000 | Roland |
| 6,029,309 | A | 2/2000 | Imamura |
| 6,033,082 | A | 3/2000 | Lin |
| 6,049,143 | A | 4/2000 | Simpson et al. |
| 6,101,667 | A | 8/2000 | Ishikawa |
| D431,335 | S | 9/2000 | Mehaffey et al. |
| 6,169,258 | B1 | 1/2001 | Roney et al. |
| 6,206,181 | B1 | 3/2001 | Syverson |
| 6,218,798 | B1 | 4/2001 | Price et al. |
| 6,232,696 | B1 | 5/2001 | Kim et al. |
| 6,239,576 | B1 | 5/2001 | Breslin et al. |
| 6,244,427 | B1 | 6/2001 | Syverson |
| 6,253,414 | B1 | 7/2001 | Bradd et al. |
| 6,256,833 | B1 | 7/2001 | Steinberg |
| 6,323,570 | B1 | 11/2001 | Nishimura et al. |
| 6,336,825 | B1 | 1/2002 | Seefried |
| 6,425,293 | B1 | 7/2002 | Woodroffe et al. |
| 6,459,056 | B1 | 10/2002 | Graham |
| 6,463,368 | B1 | 10/2002 | Feiten et al. |
| 6,546,814 | B1 | 4/2003 | Choe et al. |
| 6,628,019 | B2 | 9/2003 | Carroll |
| 6,658,325 | B2 | 12/2003 | Zweig |
| 6,685,491 | B2 | 2/2004 | Gergek |
| 6,690,804 | B2 | 2/2004 | Everett |
| D494,332 | S | 8/2004 | Schroeter |
| D494,333 | S | 8/2004 | Schroeter |
| 6,779,228 | B2 | 8/2004 | Plomteux et al. |
| 6,791,205 | B2 | 9/2004 | Woodbridge |
| 6,817,058 | B1 | 11/2004 | Harrelson, II |
| 6,822,353 | B2 | 11/2004 | Koga et al. |
| 6,864,594 | B2 | 3/2005 | Seki |
| 6,900,565 | B2 | 5/2005 | Preston |
| 6,975,043 | B2 | 12/2005 | Schumacher et al. |
| 6,975,993 | B1 | 12/2005 | Lin |
| 7,051,398 | B2 | 5/2006 | Smith et al. |
| 7,080,425 | B2 | 7/2006 | Smith et al. |
| 7,114,216 | B2 | 10/2006 | Stephens et al. |
| 7,122,921 | B2 | 10/2006 | Hall et al. |
| 7,237,298 | B2 | 7/2007 | Reindle et al. |
| 7,269,877 | B2 | 9/2007 | Tondra et al. |
| 7,328,479 | B2 | 2/2008 | Willenbring |

| | | | | |
|---|---|---|---|---|
| 7,331,083 | B2 | 2/2008 | Overvaag et al. | |
| 7,342,372 | B2 | 3/2008 | Jonsson et al. | |
| 7,363,679 | B2 | 4/2008 | Zimmerle et al. | |
| 7,403,360 | B2 | 7/2008 | Cunningham et al. | |
| 7,406,744 | B2 | 8/2008 | Bruneau | |
| 2002/0001190 | A1 | 1/2002 | Everett | |
| 2002/0127916 | A1 | 9/2002 | Zhang | |
| 2002/0152576 | A1 | 10/2002 | Murray et al. | |
| 2003/0044243 | A1 | 3/2003 | Tisdale | |
| 2003/0140443 | A1 | 7/2003 | Najm | |
| 2003/0196293 | A1 | 10/2003 | Ruff | |
| 2004/0031506 | A1 | 2/2004 | Tsai | |
| 2004/0049868 | A1 | 3/2004 | Ng | |
| 2004/0144633 | A1 | 7/2004 | Gordon et al. | |
| 2004/0150271 | A1 | 8/2004 | Koga et al. | |
| 2004/0172782 | A1 | 9/2004 | Smith et al. | |
| 2004/0177468 | A1 | 9/2004 | Smith et al. | |
| 2004/0231090 | A1 | 11/2004 | Kushida et al. | |
| 2004/0261211 | A1 | 12/2004 | Overvaag et al. | |
| 2005/0022329 | A1 | 2/2005 | Harman et al. | |
| 2005/0022337 | A1 | 2/2005 | Roney et al. | |
| 2005/0166351 | A1 | 8/2005 | Cunningham et al. | |
| 2005/0236012 | A1 | 10/2005 | Josefsson et al. | |
| 2005/0245194 | A1 | 11/2005 | Hayes et al. | |
| 2005/0254185 | A1 | 11/2005 | Cunningham | |
| 2007/0283521 | A1 | 12/2007 | Foster et al. | |
| 2008/0066252 | A1 | 3/2008 | Herron, Jr. | |
| 2008/0222836 | A1 * | 9/2008 | Cunningham | 15/314 |
| 2008/0301903 | A1 | 12/2008 | Cunningham et al. | |

FOREIGN PATENT DOCUMENTS

| | | | |
|---|---|---|---|
| EP | 0347223 | | 12/1989 |
| EP | 0552978 | A2 | 1/1993 |
| EP | 0499235 | B1 | 9/1995 |
| EP | 0711023 | A2 | 5/1996 |
| EP | 0773619 | A1 | 5/1997 |
| GB | 2281507 | | 3/1995 |
| GB | 2288115 | | 10/1995 |
| JP | 53058160 | A2 | 5/1978 |
| JP | 53128158 | A2 | 11/1978 |
| JP | 64-049526 | | 2/1989 |
| JP | 2-152420 | | 6/1990 |
| JP | 2-152419 | | 12/1990 |
| JP | 4-017830 | | 1/1992 |
| JP | 5-003839 | | 1/1993 |
| JP | 5-317213 | | 3/1993 |
| JP | 06277167 | A2 | 10/1994 |
| JP | 7-095944 | | 11/1995 |
| JP | 07322980 | | 12/1995 |
| JP | 8-240329 | | 9/1996 |
| JP | 9-149871 | | 10/1997 |
| JP | 2009-058919 | | 9/1998 |
| JP | 2000116577 | A2 | 4/2000 |
| JP | 2001137158 | A2 | 5/2001 |
| JP | 2002-078656 | | 3/2002 |
| JP | 2002320577 | | 5/2002 |
| JP | 2005-102465 | | 4/2005 |
| WO | 9737423 | | 10/1997 |
| WO | WO9741631 | | 11/1997 |
| WO | 98/35160 | | 8/1998 |
| WO | 99/09875 | | 3/1999 |
| WO | 9956606 | | 11/1999 |
| WO | WO0064323 | A1 | 11/2000 |
| WO | 2005/031169 | | 4/2005 |
| WO | 2007/017057 | | 2/2007 |

OTHER PUBLICATIONS

Audioetcetera, Wireless Remote Control for Filtex Central Vacuum Systems, M&S Systems, date unknown, http://www.audio-etcetera.com/prod.itml/icOid/135540.

Central Vacuum Systems Owners Guide, M&S Systems, date unknown, Dallas, Texas.

Japan Patent Office computer translation of publication No. JP2000116577A2, printed Jan. 19, 2005, pp. 21.

Japan Patent Office computer translation of publication No. JP2001137158A2, printed Jan. 19, 2005, pp. 42.

Japan Patent Office computer translation of publication No. JP06277167A2, printed Jan. 21, 2005, pp. 16.

Japan Patent Office computer translation of publication No. JP2002320577, printed Jan. 24, 2005, pp. 18.

Japan Patent Office computer translation of publication No. JP07322980, printed Jan. 24, 2005, pp. 14.

Japan Patent Office English translation of abstract of publication No. JP53058160A, printed Feb. 17, 2005, pp. 1.

Japan Patent Office English translation of abstract of publication No. JP53128158A, printed Feb. 17, 2005, pp. 1.

Japan Patent Office computer translation of publication No. JP08-117165, Vacuum Cleaner and Its Operation Control, publication date May 14, 1996.

Japan Patent Office computer translation of publication No. JP10-094504, Vacuum Cleaner, publication date Apr. 14, 1998.

Japan Patent Office computer translation of publication No. JP2003-235767, Vacuum Cleaner, publication date Aug. 26, 2003.

Japan Patent Office computer translation of publication No. JP08-065876, Overcurrent Protection Device, publication date Mar. 8, 1994.

Patent Abstracts of Japan, JP08033596A2, Electric Vacuum Cleaner, publication date Feb. 6, 1996.

Ultimate Air Inc., The UltimateAir RecoupAerator 200DX Energy Recovery Ventilator, Owner's Manual and Installation Guide, Jan. 24, 2006, pp. i-iv, 1-41Athens, USA.

Heritage Central Vacuum, Crush Proof Hoses Non-Electric, http://www.heritagevac.com/hosesnonelectric.html, printed Sep. 21, 2005, pp. 4, Azusa, USA.

International Search Report for PCT/CA03/00382 dated Jul. 10, 2003.

The Eureka Company, Cordless, Rechargeable Vacuum Cleaner, Household Type, Owner's Guide, Model 570, 2000, pp. 12, Bloomington, USA.

The Eureka Company, Cordless, Rechargeable Vacuum Cleaner, Household Type, Owner's Guide, Model 96B, 2001, pp. 12, Bloomington, USA.

* cited by examiner

CENTRAL VACUUM CLEANER CROSS-CONTROLS

This application claims priority from, and is entitled to the benefit of the filing date of, U.S. patent application No. 60/784,770 entitled CENTRAL VACUUM CLEANER CROSS-CONTROLS filed 23 Mar. 2006; U.S. patent application No. 60/724,290 entitled VACUUM CLEANER CROSS-CONTROL filed 7 Oct. 2005; and U.S. patent application No. 60/777,528 entitled CENTRAL VACUUM CLEANER CROSS-CONTROLS filed 1 Mar. 2006. The content of each of the above applications is hereby incorporated by reference into the detailed description hereof.

FIELD OF THE INVENTION

The invention relates to vacuum cleaners.

BACKGROUND OF THE INVENTION

Central vacuum cleaning systems were originally quite simple. One placed a powerful central vacuum source external to the main living space. The source was connected through interior walls to a long flexible hose that terminated in a handle and nozzle. When an operator desired to use the system, the operator went to the source and turned it on. The operator then went inside, picked up the handle and directed the nozzle to an area to be cleaned.

Although many elements of the basic system remain, many improvements have been made. Rigid pipes typically run inside interior walls to numerous wall valves spaced throughout a building. This allows an operator to utilize a smaller hose while covering an equivalent space. This is an advantage as the hose can be quite bulky and heavy.

Various communication systems have been developed. Some systems sense sound or pressure in the pipes to turn the vacuum source on or off, see for example U.S. Pat. No. 5,924,164 issued 20 Jul. 1999 to Edward W. Lindsay under title ACOUSTIC COMMUNICATOR FOR CENTRAL VACUUM CLEANERS. Other systems run low voltage wires between the source and the wall valve. The source can be turned on and off at a wall valve by a switch that may be activated by insertion or removal of the hose. The hose may also contain low voltage wires to allow the source to be controlled from a switch in the handle, see for example U.S. Pat. No. 5,343,590 issued 6 Sep. 1994 to Kurtis R. Radabaugh under title LOW VOLTAGE CENTRAL VACUUM CONTROL HANDLE WITH AN AIR FLOW SENSOR. The switch can be a simple toggle switch, or a more sophisticated capacitive switch.

The low voltage wires running along the pipes can be replaced by conductive tape or the like on the pipes, see for example U.S. Pat. No. 4,854,887 issued 8 Aug. 1989 to Jean-Claude Blandin under title PIPE SYSTEM FOR CENTRAL SUCTION CLEANING INSTALLATION. Separate low voltage conductors in the walls can be avoided altogether by home using mains power wires to transmit communication signals between the wall valve and the source, see for example U.S. Pat. No. 5,274,878 issued 4 Jan. 1994 to Kurtis R. Radabaugh, et al. under title REMOTE CONTROL SYSTEM FOR CENTRAL VACUUM SYSTEMS. A handheld radio frequency wireless transmitter can be used by an operator to turn the source on or off, see for example U.S. Pat. No. 3,626,545 issued 14 Dec. 1971 to Perry W. Sparrow under title CENTRAL VACUUM CLEANER WITH REMOTE CONTROL.

Line voltage can be brought adjacent the vacuum wall valves and connected to the handle through separate conductors, or integrated spiral wound conductors on the hose. Line voltage can then be brought from the handle to powered accessories, such as an electrically-powered beater bar, connected to the nozzle. Line voltage can be switched on and off to the powered accessory using the same switch in the handle that controls the source. Alternatively, the powered accessory may have its own power switch.

A control module mounted to the central vacuum unit is typically used to control the vacuum source. As central vacuum cleaning systems have become more and more sophisticated, so has the control module.

Improvements to, or additional or alternative features for, central vacuum cleaning systems are desirable.

SUMMARY OF THE INVENTION

In a first aspect, the invention provides a vacuum cleaning system for use in a structure. The system includes a receiver adapted to receive communications that an appliance has been activated, and a control circuit adapted to control the central vacuum cleaning system upon receipt of a communication at the receiver that the appliance has been activated.

The appliance may be a telephone and the telephone may be activated when there is an incoming call on the telephone.

The control circuit may be adapted to activate an alert in the vacuum cleaning system to alert a user to an incoming telephone call.

The alert may be a visual or tactile alert.

The control circuit may be adapted to turn off the cleaning system when there is an incoming telephone call.

The appliance may be a doorbell.

The control circuit may be adapted to activate an alert in the vacuum cleaning system to alert a user to activation of the doorbell.

The control circuit may be adapted to turn off the cleaning system when the doorbell is activated.

The adapter may be adapted to sense activation of the appliance and transmit a communication to the receiver.

The adapter may be a telephone line adaptor that may be adapted to sense incoming calls on the telephone line.

The adapter may be a doorbell adapter that may be adapted to sense activation of the doorbell.

The receiver may be a wireless radio frequency receiver and the communications may be wireless radio frequency communicators.

In a second aspect, the invention provides combination for use in a structure. The combination includes a vacuum cleaning system in the structure, an appliance in the structure, a system communications module associated with the system, and an appliance communications module associated with the appliance. The system communications module and appliance communications module is adapted to transmit communications to one another and to receive communications from one another. Such communications communicate a condition of the system or appliance with which the transmitting module is associated to the receiving module. The appliance or system with which the receiving module is associated is adapted to be controlled in accordance with the received communications.

In another aspect the invention provides a combination for use in association with a structure. The combination includes a vacuum cleaning system in the structure, an air intake device, a system communications module associated with the system, and an air intake device communications module associated with the an air intake device. The system communications module is adapted to transmit communications and the air intake device communications module is adapted to receive communications from the system communications module. The air intake device is adapted to provide make-up supply air to the structure in proportion to running time of the vacuum cleaning system.

The air intake device may be an energy recovery ventilator (ERV) in the structure. The ERV may be a heat recovery ventilator (HRV). The system communications module may be adapted to transmit wirelessly, and the air intake device communications module may be adapted to receive the transmissions wirelessly.

The vacuum cleaning system may be a central vacuum cleaning system including a central control module adapted to controlling a vacuum source of the system and including a remote control module adapted to wirelessly transmitting communications to the central control module. The air intake device communications module may be adapted to receive transmissions wirelessly from the remote control module.

The air intake device may be a blower. The air intake device may be adapted to utilize pressure differential to draw in make-up air to the structure. The air intake device may be a damper.

In a fourth aspect the invention provides a method of controlling a central vacuum cleaning system. The method includes receiving communications at the central vacuum cleaning system when an appliance has been activated, and controlling the central vacuum cleaning system upon receipt of the communications.

Other aspects of the invention, including control modules and components thereof and methods of operation, will be evident from the principles contained in the description and drawings herein.

BRIEF DESCRIPTION OF THE DRAWINGS

For a better understanding of the present invention and to show more were clearly how it may be carried into effect, reference will now be made, by way of example, to the accompanying drawings that show the preferred embodiment of the present invention and in which.

DETAILED DESCRIPTION OF THE PREFERRED EMBODIMENT

Figure 1:
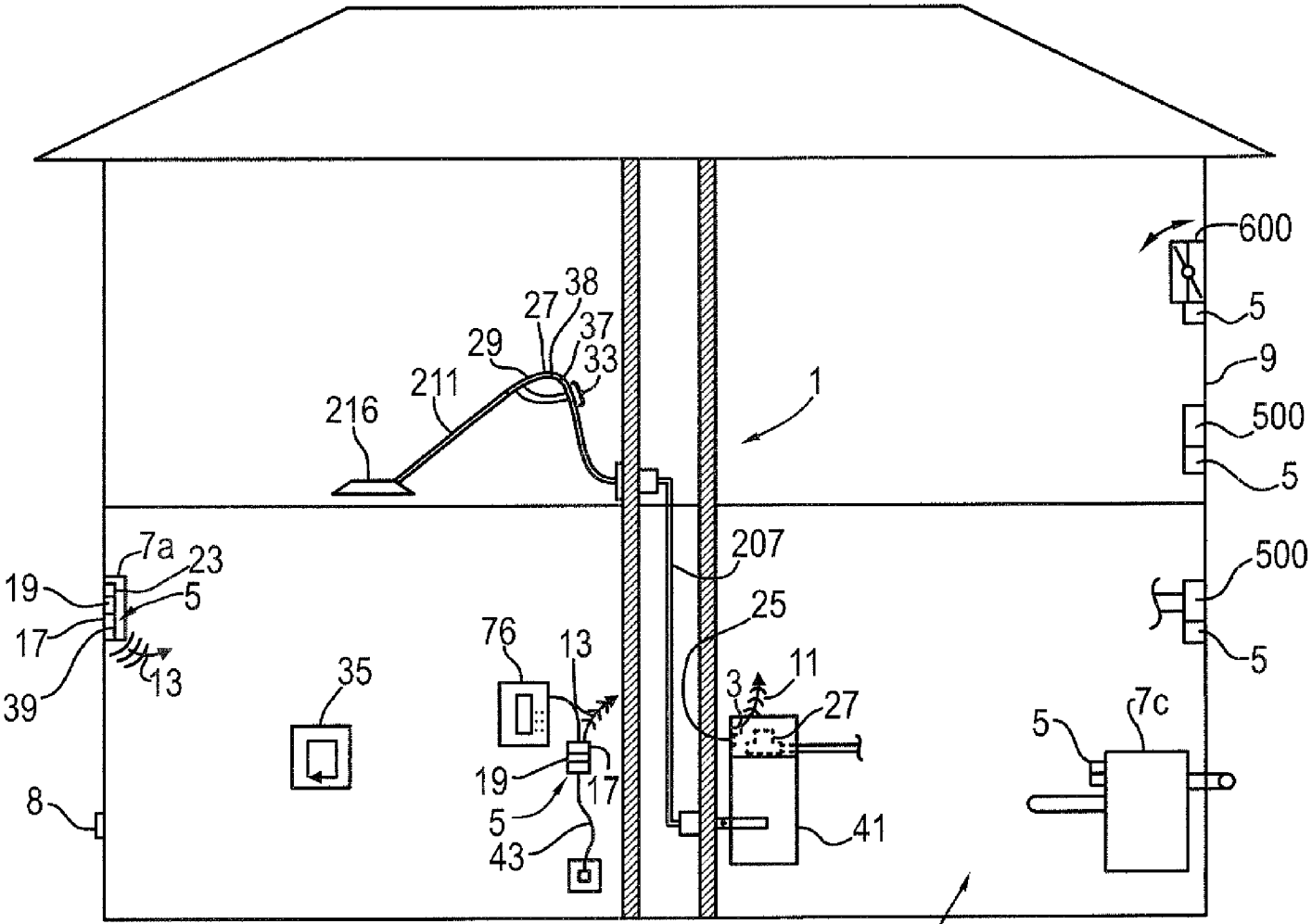
FIG. 1 is a cross-section of a structure incorporating a central vacuum cleaning system control subsystem and ERV control subsystem in accordance with a preferred embodiment of the present invention.

Referring to FIG. 1, a vacuum cleaning system 1 has a communication module 3 that communicates with corresponding appliance communication module(s) 5 for appliance(s) 7. The system communication module 3 may transmit communications 11 to the appliance communication module 5. Alternatively, the module 5 may transmit communications 13 to the module 3. The modules 3, 5 may both receive and transmit. Preferably, the communications 11, 13 are radio frequency (RF) wireless as shown; however, wired communications, where wiring is possible or available, are also suitable. To the extent that the modules 3, 5 are to transmit communications, each incorporates a transmitter 17, not shown in module 3. To the extent that the modules 3, 5 are to receive communications, each incorporates a receiver 19, not shown in module 3.

As is clear from the detailed description hereof, an appliance 7 is a device separate from the central vacuum system 1. The appliance 7 performs a task unassociated with the function of the central vacuum cleaning system 1.

As an example, the appliance 7 may be an electrically-activated doorbell 7*a*. The doorbell 7*a* is electrically activated when a user presses a switch 8 adjacent to a door. The communications module 5 incorporates a sensor 23 that recognizes electrical activation of the doorbell. The communication module 5 transmits through transmitter 17 a communication 13 to the module 3. The receiver in the module 3 receives the communications 13.

The system 1 has a system control circuit 25 that controls the cleaning system 1 in accordance with the communication 13 received by the communication module 3. For example, if the cleaning system 1 is on and the control circuit 25 determines that vacuum source 27 is operating, then there may be significant noise in the structure 9. The control circuit 25 may assist the user by alerting the user to the activation of the doorbell.

The alert may be in the form of a visual alert, such as an LED 27 flashing on a hose handle 29, an icon alert flashing or displayed on an LCD screen 33 on the house handle 29, or similar visual alerts on a remote display for system 1, such as a wall display 35.

The alert may be in the form of a tactile alert, such as a vibration mechanism 37 in the hose handle 29. The control circuit 25 may turn off power to the vacuum source 27 upon activation of the doorbell.

For central vacuum cleaners, the alert may be in the form of an audible alert, such as a buzzer, horn or other sound generator 38 in the hose handle 29. An audible alert may also be used in a portable vacuum cleaner; however, its effectiveness may be limited by noise from vacuum source.

As a further example, the module 3 may transmit a communication 11 through transmitter 15 to the doorbell appliance module 5 receiver 19. The doorbell appliance module 5 has a control circuit 39 to activate the doorbell. The doorbell can be activated in a given pattern to indicate that it is not a regular doorbell activation, but rather that the system 1 requires attention. The control circuit 25 may provide additional information through the alerts previously described, or other locations such as at vacuum unit 41.

As a further example, the appliance 7 may be a telephone 7*b*. The module 5 may be a telephone line adapter that senses an incoming call on the line 43. Similar to the functions of the module 5 when used with the doorbell, it communicates to the module 3, which behaves in a similar manner, including perhaps illuminating a telephone icon.

The module 5 as telephone line adapter can also be used to activate a ring at the telephone. The ring may be in a distinctive pattern, or the module may cause a message to be played indicative of the alert, or simply indicating that the system 1 should be checked for further information.

As a further example, central vacuum systems are typically exhausted outside the dwelling and this can cause negative pressure in an airtight structure.

The appliance 7 may be a heat recovery unit or heat recovery ventilator (HRV) or energy recovery unit, more currently and generically referred to as an energy recovery ventilator (ERV), 7*c*. Those ERVs that exchange relatively warm air from a structure with cooler outside air to maintain the heating efficiency of a structure are often described using the terms heat recovery units or heat recovery ventilators (HRVs). Those ERVs that exchange relatively cool air from a structure with warmer outside air to maintain the cooling efficiency of a structure are typically referred to as energy recovery units or energy recovery ventilators (ERVs). It is to be understood that both heating and cooling air exchangers fall under the generic term ERVs and operate under the same principles. ERVs can be configured to operate as both heating and cooling air exchangers at different times. Often ERVs are optimized for heating or cooling efficiency and marketed under different names; however, they fall under the broad category of ERVs.

In today's virtually airtight structures, an ERV 7*c* is used to bring in air from outside the structure 9 while recovering energy from the exhausted air. When control circuit 25 senses operation of the vacuum source 41, the module 3 can be directed to communicate this via communication 11.

Module 5 at the ERV 7*c* receives the communication 11 through receiver 17. The module 5 activates the ERV 7*c* to let in more air to the structure 9.

Any of the modules 5 discussed herein may be separate from their related appliance or integrated with it.

As an example, the system 1 may send a communication 11 to an appliance 7 when it requires servicing, such as bag full, motor bearing, or motor brush servicing. As another example, the system 1 may also send a communication 11 to an appliance 7 when it senses an environmental condition worthy of alerting a user, see for example, co-pending United States utility patent application of Allen D. Muirhead and J. Vern Cunningham filed 7 Oct. 2005 under title CENTRAL VACUUM CLEANER CONTROL, UNIT AND SYSTEM WITH CONTAMINANT SENSOR and application Ser. No. 11/245,218 the content of which is hereby incorporated by reference into this detailed description.

Figure 2:
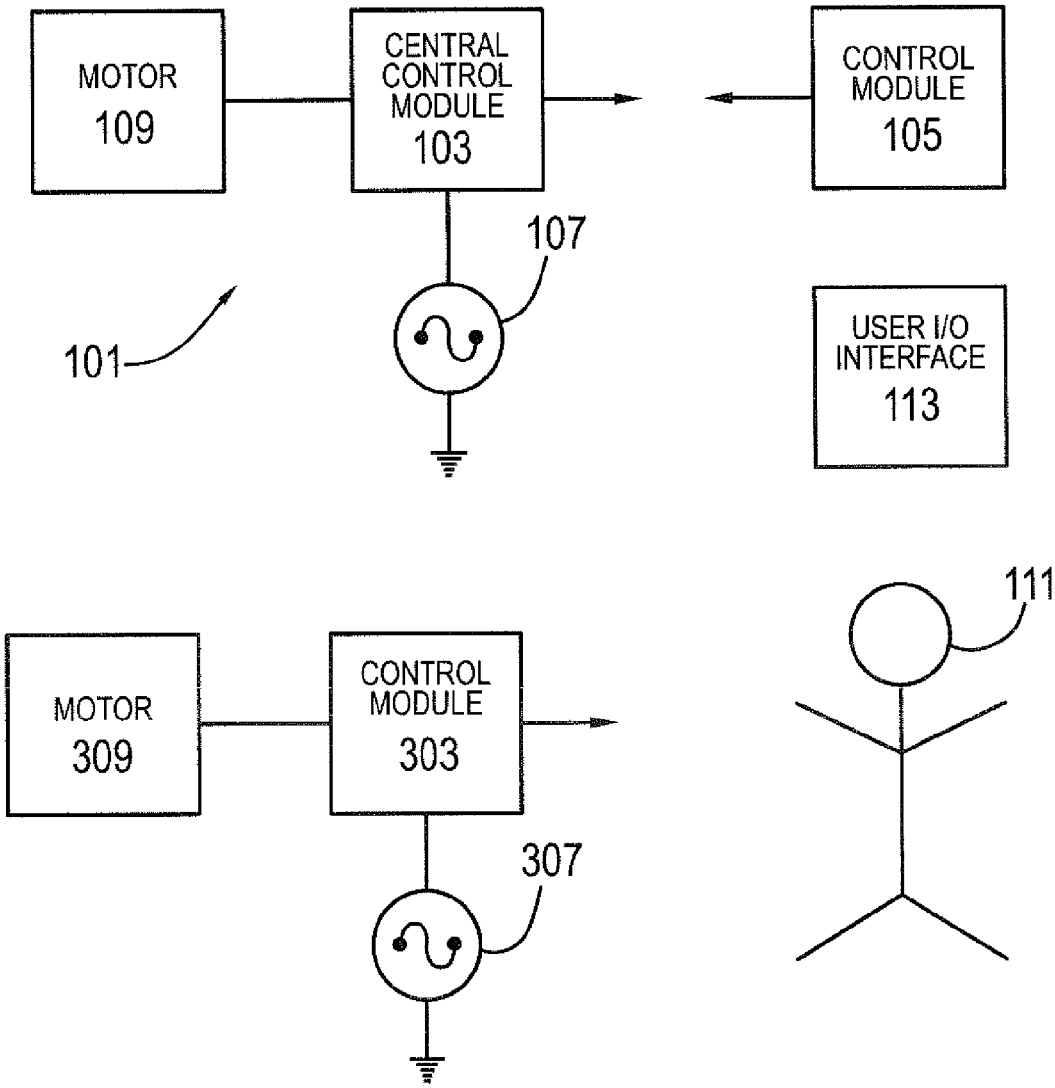
FIG. 2 is a schematic diagram of a central vacuum cleaning system control subsystem and ERV control subsystem in accordance with the preferred embodiment of the present invention.

Referring to FIG. 2, detailed examples of central vacuum system/ERV combinations with cross-control will be described herein. A central vacuum cleaning system control subsystem 100 has a vacuum central control module 103 and a remote control module 105. An ERV control subsystem 300 has an ERV control module 303.

The central control module 103 controls power from a power source 107 to a motor 109, and by doing so the central control module 103 controls the operation of the motor 109. The power source 107 is typically line voltage, for example, 120V or 240V, 60 Hz AC in North America or 230V, 50 Hz AC in Europe.

The remote control module 105 is connected to a user input/output interface 113. The remote control module 105 receives input from a user 111 through the interface 113. User input may be as simple as a request for a change of state of the motor 109 where the interface 113 would be a toggle switch 113.

The ERV control module 303 controls power from a power source 307 to motors 309, and by doing so the ERV control module 303 controls the operation of the motors 309. The power source 307 is typically line voltage, for example, 120V or 240V, 60 Hz AC in North America or 230V, 50 Hz AC in Europe.

The remote control module 105 is a wireless transmitter. It encodes the input received from the user for wireless transmission to the central control module 103 as indicated by the arcs 115. It also provides wireless transmissions to the ERV control module 303 as indicated by the arcs 115.

The central control module 103 is a wireless receiver. It receives the wireless transmission from the remote control module 105, decodes it and controls the motor 109 accordingly. For example, if the user requests the motor 109 to change state then if the central control module 103 is providing power from the source 107 to the motor 109 then the central control module 103 will cease doing so. If the central control module 103 is not providing power from the source 107 to the motor 109 then it will provide power.

The ERV control module 303 is a wireless receiver. It receives wireless transmissions from the remote control module 105, decodes them and controls the motors 309 accordingly.

The central control module 103 is also a wireless transmitter. The central control module 103 senses the operating condition of the motor 109, encodes a message related to the condition and wirelessly transmits the message to the remote control module 105 as indicated by the arcs 117. The message is received by the remote control module 5, decoded, and provided to the user through the interface 113.

The ERV control module 303 is also a wireless transmitter. The ERV control module 303 senses the operating condition of the motors 309, encodes a message related to the condition and wirelessly transmits the message to the remote control module 105 as indicated by the arcs 317. Such a message received by the remote control module 105, is decoded, and provided to the user through the interface 113.

Figure 3:
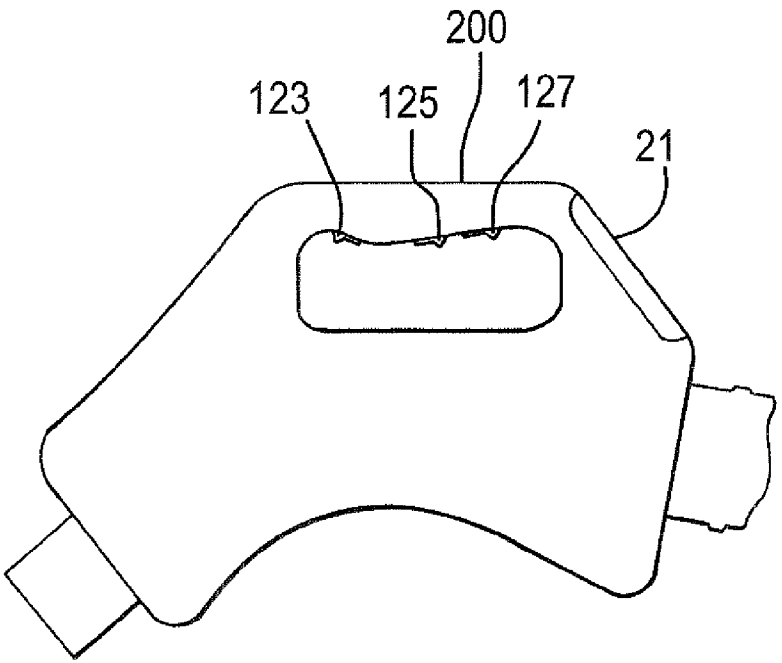
FIG. 3 is a side view of a central vacuum cleaning system hose handle for use with the subsystem of FIG. 2.

Referring to FIG. 3, a hose handle 200 incorporates the interface 113 as a display means 121 and switch 123. A toggle switch 123 is shown in the FIGS.; however, various types of switches, such as for example a momentary switch, not shown, could be used. The display means 121 may take the form of one or more lights, such as LEDs and/or an LCD screen with icons. Alternatively, or in addition, the display means may have a speaker or buzzer to provide sound output to the user by way of voice or an alarm. A transducer may be used to create sounds. This provides bi-directional communication between the central control module 103 and the remote control module 105, and between the remote control module 105 and the ERV control module 303, and thereby provides bidirectional communication between the user 111 and the motor 109, and the user 111 and the motors 309, as will be discussed further herein.

In a preferred embodiment, the central control module 103 is able to provide more complex control of the motor 109 beyond simply turning it on and off. For example, the central control module 103 may be able to adjust the speed at which the motor 109 operates. There are many different techniques for adjusting motor 109 speed, some of which are dependent on the type of motor 109.

For example, existing central vacuum cleaning systems typically use a universal motor 109. The speed of a universal motor 109 can be controlled by reducing the voltage applied to the motor 109. DC motors 109 have also been described for use as vacuum motors 109, see for example, co-pending PCT Patent Application No. PCT/CA03/00382 filed 12 Mar. 2003, published 18 Sep. 2003 as WO03075733A1, and claiming the benefit of U.S. Provisional Patent Application No. 60/363,351 filed 12 Mar. 2002. The content of the above applications is hereby incorporated by reference into the Detailed Description hereof. The speed of a DC motor 109 can be adjusted by adjusting the voltage for a series wound motor 109, or by controlling the excitation on the armature of a shunt wound motor 109.

Where the central control module 103 has the ability to control motor 109 speed then it may be desirable to provide for a "soft start". This can be done by starting the motor 109 at a slower desired speed and working up to a higher speed. This can increase the longevity of the motor 109, particularly for universal motors 109 where starting can result in a high inrush current that has a cumulative detrimental effect on motor 109 windings over time. Soft start control can be configured as an internal setting of the central control module 103 without requiring external user input.

The user 111 can be permitted to adjust the speed of the motor 109 on demand by requesting such an adjustment through the user input/output interface 113. This can be done by providing additional user inputs at the interface 113, for example more switches 125, 127, or it may be more effectively done by interpreting the signals from the user 111 through a lesser number of inputs, for example switch 123 only. For example, the switch 123 can be actuated to signal a particular request. A series of switch 123 actuations may signal a request for a decrease motor 109 speed another series of switch 123 actuations may signal a request for an increase in motor 109 speed. Another signal would indicate on and another off.

An easier interface 113 for the user 111 would include two switches 123, 125. Repeated actuation of one switch 123 signals a request for an increase in speed, while repeated actuation of the other switch 125 signals a request for a decrease in speed. A single actuation of one switch 123 could indicate a request to turn the motor 109 on, while a single actuation of the other switch 125 could indicate a request to turn the motor 109 off. For example, each request for a decrease in speed could result in a 10% reduction to a maximum of a 50% reduction. Rather than incrementally increasing speed, the user could be required to request the motor 109 to be turned off and then on through the interface 113. This could reset the speed to 100%.

More switches or input devices, not shown, could be added as desired. For example, the user can also be permitted through the user interface 113 manually to control the motors 309, by activating the motors 309 or changing the speed of the motors 309. Preferably user input to the interface 113 to turn on and off the motor 109 is used by the remote control module 105 to communicate with the ERV control module 303 in order to provide automated control of the motors 309. The motors 309 could be controlled based simply on a user 111 requesting the motor 109 to be turned on and subsequently based on a user 111 requesting the motor 109 to be turned off. For example, the ERV 7*c* could be controlled to turn on when the user 111 requests the motor 109 to be turned on, and the ERV 7*c* could be controlled to turn off when the user 111 requests the motor 109 to be turned off.

When the ERV 7*c* is turned on it could be controlled to draw in supply air only to make up for air that is exhausted by the central vacuum system. Alternatively, the ERV could be controlled to draw in supply air and take out exhaust air, while providing an offset to draw in more supply air than the ERV exhausts.

Preferably, the amount of time that the motor 109 is turned on is tracked and the motors 309 are controlled after a delay time period to draw in make-up supply air that is proportional to the air exhausted by the central vacuum cleaning system. The delay period is set to allow running time of motor 109 to accumulate before controlling the motors 309. The delay period is beneficial as motor 109 may be switched on and off during vacuuming. The delay period allows the motors 309 to be controlled less often for each vacuuming session, preferably once. This can reduce wear on the motors 309. Although a modern ERV 7*c* is quite quiet, the delay period can also reduce annoyance from changes in background noise in the structure from numerous changes in state of the ERV 7*c*.

The delay period could, for example, be 15 minutes. The delay period should reflect an amount of time during which a user 111 would ordinarily take during vacuuming to run the motors 109 for an accumulated period of time that justifies running of the ERV 7*c*. It can also reflect an amount of time that it would ordinarily take for a person to complete a vacuuming task.

A minimum running threshold can be used such that the ERV 7*c* does not draw in make-up supply air until more than a given period of accumulated running time has elapsed. This avoids turning on the ERV 7*c* for minor or inadvertent uses of the vacuum cleaning system. If the minimum running threshold is not reached during a given period of time (which may match the delay time or be longer) then the accumulated running time is reset to zero.

A delay override threshold can be used such that the ERV 7*c* begins drawing make-up supply air after a given period of accumulated running time for the motor 109 has elapsed. This avoids reductions of pressure during constant vacuuming.

The delay period and thresholds will ordinarily be factory set for general usage. They can be set based on specific vacuum cleaning systems and ERVs, ranges of such systems and ERVs, or generally, for example for all such residential systems.

The delay period and thresholds could be provided with default settings combined with in situ learning. For example, vacuuming session times could be tracked for multiple vacuuming sessions. The delay period could be reduced or lengthened based on actual accumulation vacuuming session statistics. For example, in a small structure where vacuum session times are typically short then the delay could be shortened. This would provide air balancing sooner. As a further example, the delay override threshold could be reduced in smaller structures. Similarly, if vacuuming session times are shorter then it might be assumed that the structure is smaller and so is the ERV. This may allow for shorter minimum running threshold times.

Figure 4:
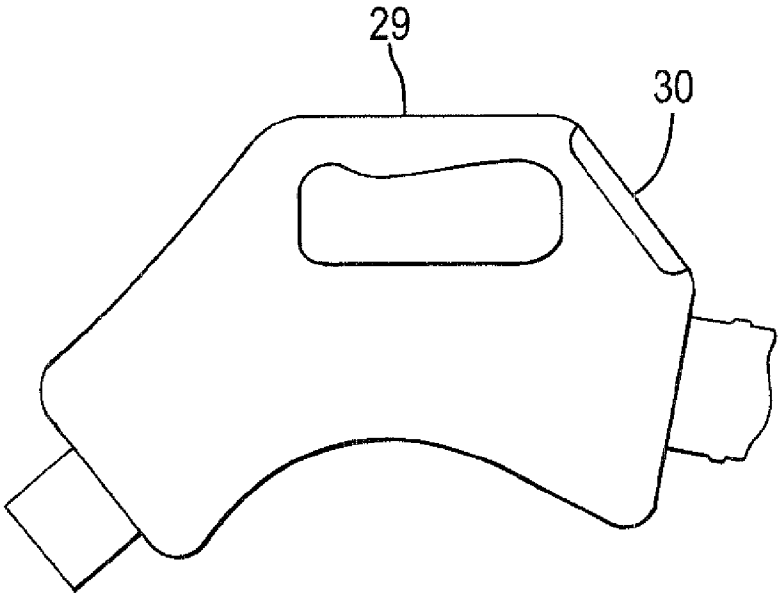
FIG. 4 is a side view of an alternate central vacuum cleaning system hose handle for use with the subsystem of FIG. 2.
Figure 5:
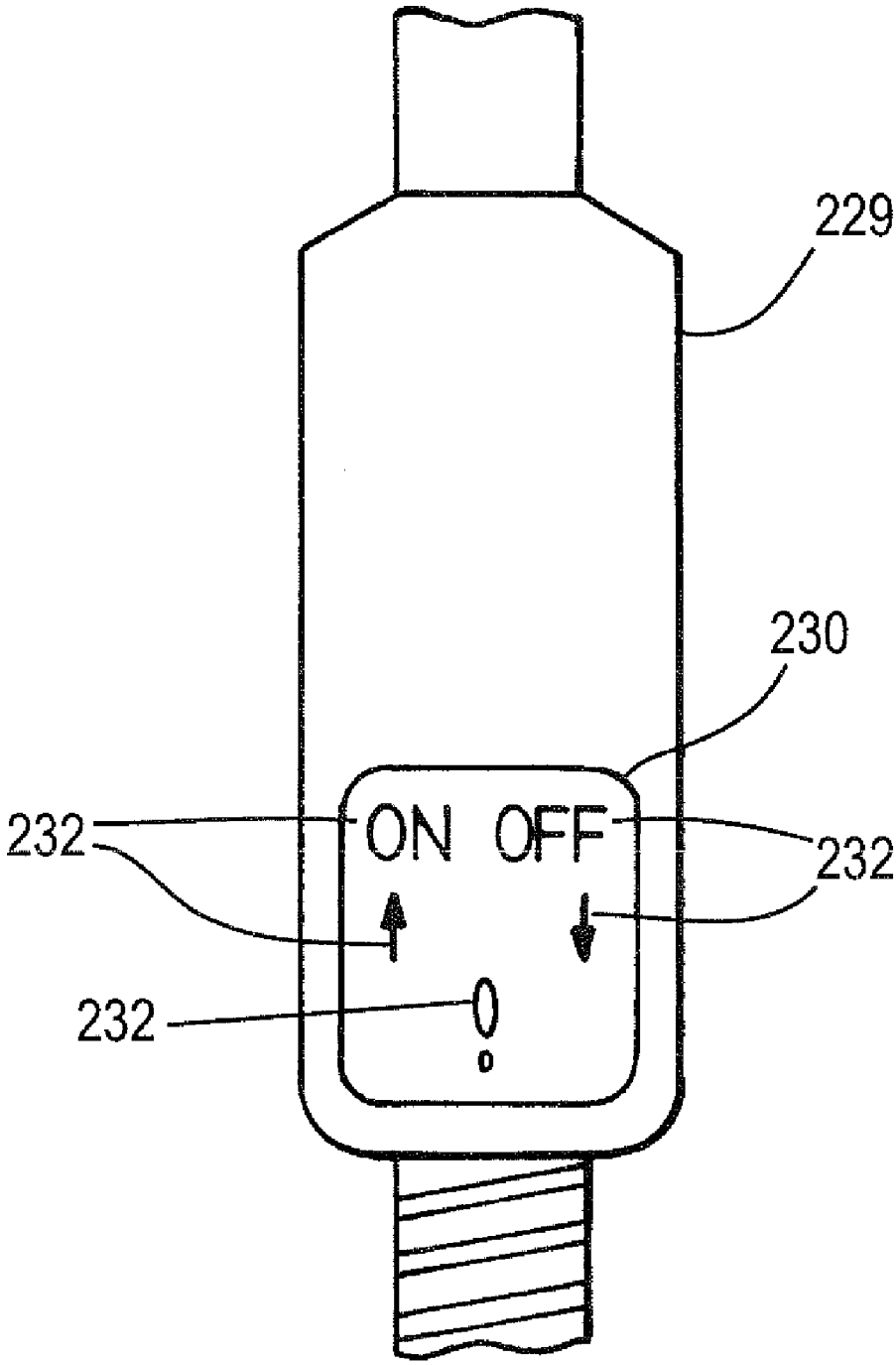
FIG. 5 is a plan view of the handle of FIG. 4.

Referring to FIGS. 4 and 5, an alternative interface 113 might be a touch screen 130 that could incorporate both a display and input device. The touch screen 130 could display various icons or text representing messages from the central control module 103 regarding the operating condition of the motor 109 and the motors 309. Icons or text could also be provided to allow the user 111 to send messages to the central control module 103 or the ERV control module 303 by touching the icons or text.

Figure 6:
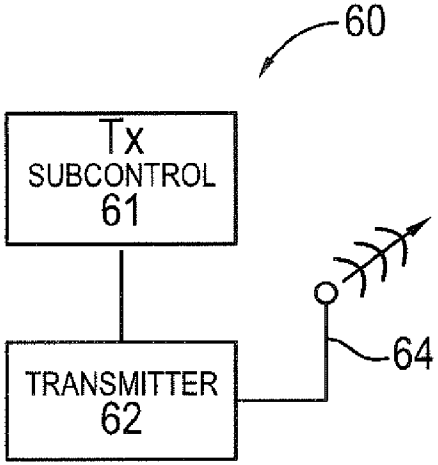
FIG. 6 is a block diagram of a central transmitter submodule for use in the central vacuum cleaning system control subsystem of FIG. 2.

The central control module 103 also has a number of submodules. Referring to FIG. 6, central transmit submodule 60 has a transmit (Tx) subcontrol 61, a wireless transmitter 62 and an antenna 64. The Tx subcontrol 61 encodes messages to be transmitted wirelessly by transmitter 62 through the antenna 64.

Figure 7:
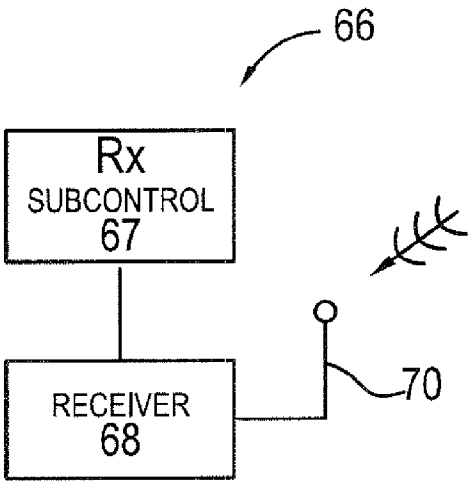
FIG. 7 is a block diagram of a central receive submodule for use in the central vacuum cleaning system control subsystem of FIG. 2.

Referring to FIG. 7, a central receive submodule 66 has a receiver (Rx) subcontrol 67, wireless receiver 68 and an antenna 70. The Rx subcontrol 67 decodes messages received by the receiver 68 through the antenna 70. The antenna 64 and 70 may be one in the same component if desired, and designed for, by the designer in a manner that would be evident to those skilled in the art.

Figure 8:
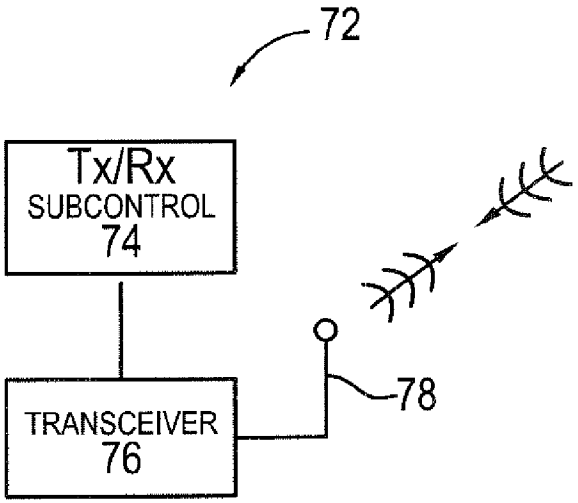
FIG. 8 is a block diagram of a central transceiver submodule for use in the central vacuum cleaning system control subsystem of FIG. 2.

Referring to FIG. 8, the central transmit submodule 60 and central receive submodule 66 may be replaced by a central transceiver submodule 72 having a transmit/receive (Tx/Rx) subcontrol 74, a transceiver 76 and an antenna 78. The submodule 72 encodes and decodes, transmits and receives messages through antenna 78 in a manner similar to the central transmit submodule 60 and the central receive submodule 66, combined.

The wireless transceiver 76 combines a transmitter and receiver in a single component. Among other benefits, the use of an integrated transceiver 76 can reduce complexity, power consumption and size. Also, transceiver for unlicensed short distance communication typically utilize higher frequencies for less interference and more effective communication.

This description will be made primarily with reference to a central transceiver submodule, such as submodule 72. It is to be understood that discrete transmit submodules, such as submodule 60, and discrete receive submodules, such as submodule 66, could be used as necessary for a particular application, if desired.

Figure 6A:
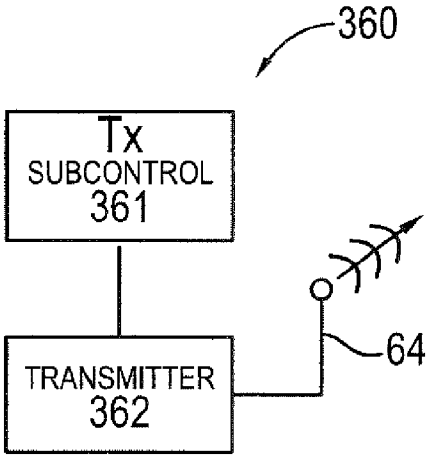
FIG. 6*a* is a block diagram of a central transmitter submodule for use in the ERV system control subsystem of FIG. 2.

The ERV control module 303 also has a number of submodules that operate based on a variety of sensed conditions. Referring to FIG. 6*a*, ERV transmit submodule 360 has a transmit (Tx) subcontrol 361, a wireless transmitter 362 and an antenna 364. The Tx subcontrol 361 encodes messages to be transmitted wirelessly by transmitter 362 through the antenna 364.

Figure 7A:
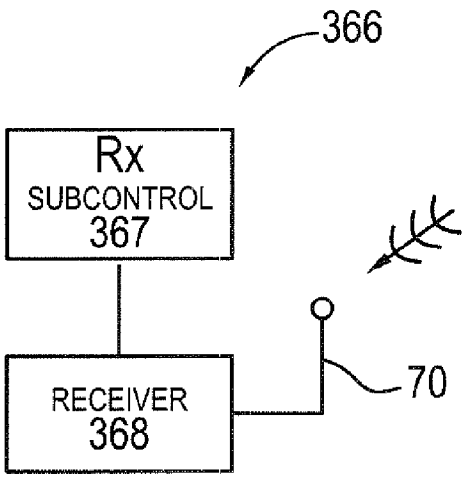
FIG. 7*a* is a block diagram of a central receive submodule for use in the ERV system control subsystem of FIG. 2.

Referring to FIG. 7*a*, ERV receive submodule 366 has a receiver (Rx) subcontrol 367, wireless receiver 368 and an antenna 370. The Rx subcontrol 367 decodes messages received by the receiver 368 through the antenna 370. The antenna 364 and 370 may be one and the same component if desired, and designed for, by the designer in a manner that would be evident to those skilled in the art.

Figure 8A:
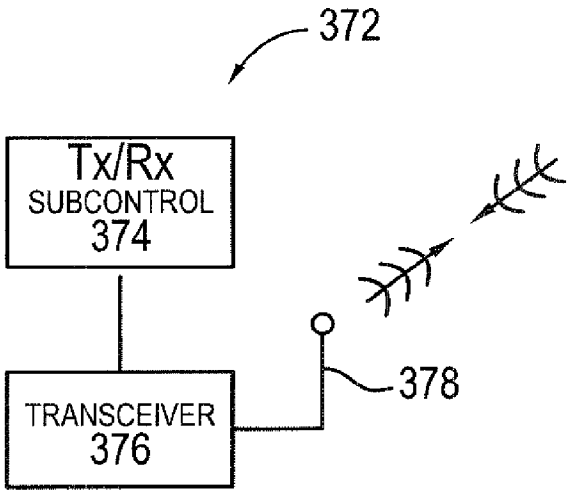
FIG. 8*a* is a block diagram of a central transceiver submodule for use in the ERV system control subsystem of FIG. 2.

Referring to FIG. 8*a*, the ERV transmit submodule 360 and ERV receive submodule 366 may be replaced by an ERV transceiver submodule 372 having a transmit/receive (Tx/Rx) subcontrol 374, a transceiver 376 and an antenna 378. The submodule 372 encodes and decodes, transmits and receives messages through antenna 378 in a manner similar to the ERV transmit submodule 360 and the ERV receive submodule 366, combined.

The wireless transceiver 376 combines a transmitter and receiver in a single component. Among other benefits, the use of an integrated transceiver 376 can reduce complexity, power consumption and size. Also, transceivers for unlicensed short distance communication typically utilize higher frequencies for less interference and more effective communication.

This description will be made primarily with reference to an EVR transceiver submodule, such as submodule 372. It is to be understood that discrete transmit submodules, such as submodule 360, and discrete receive submodules, such as submodule 366, could be used as necessary for a particular application, if desired.

Figure 9:
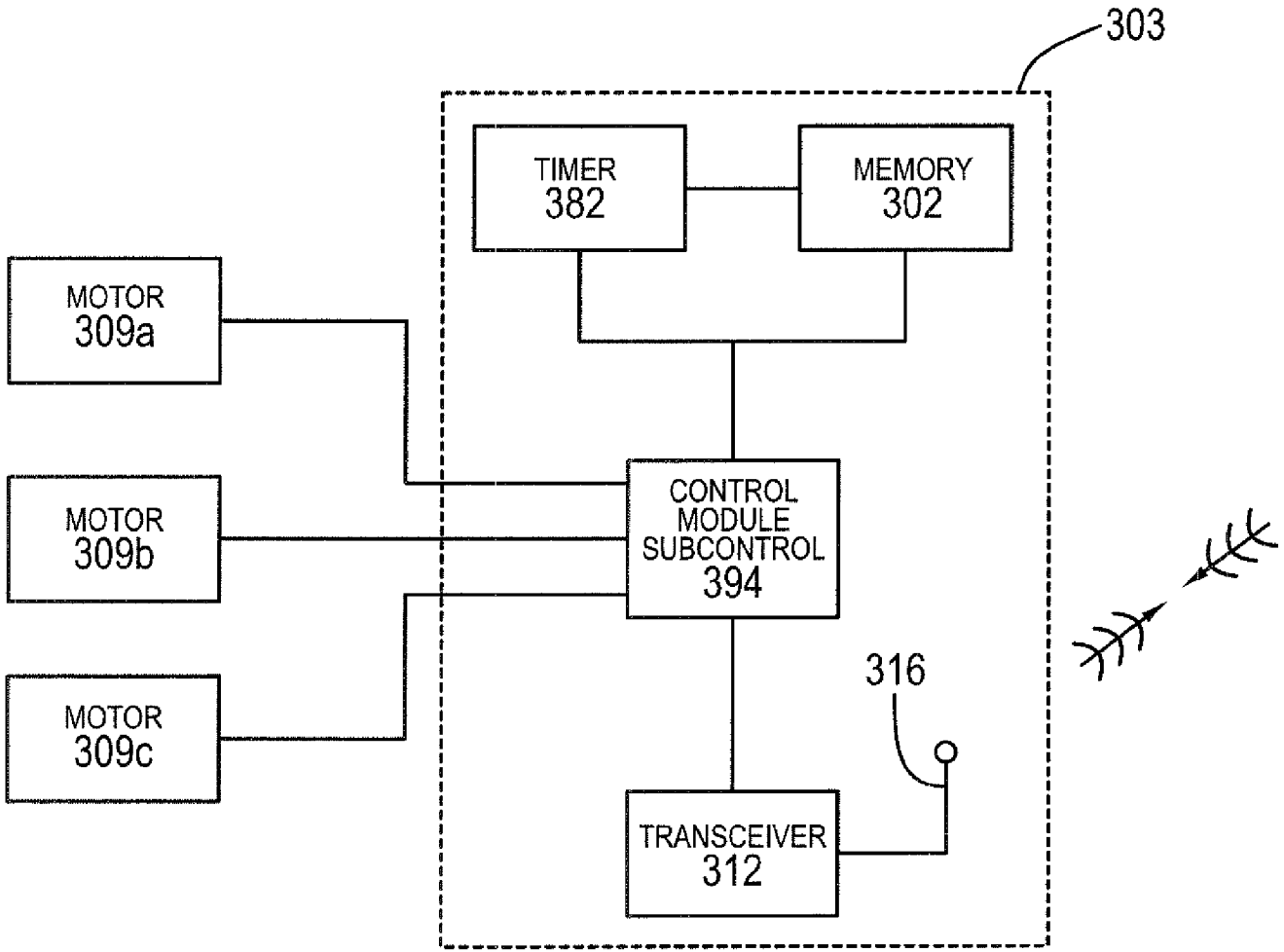
FIG. 9 is a block diagram of an ERV control module for use in the ERV control subsystem of FIG. 2.

Referring to FIG. 9, the ERV control module 303 has a timer submodule 380 with a timer 382, and a timer subcontrol 384. The timer 382 commences timing on the instruction of the subcontrol 384 when the user 111 requests activation of the motor 109 as received from the remote module 105. The timer 382 times until the ERV module 303 receives a request from the user 111 to stop the motor 109. Once a delay period has passed from the commencement of the original time then the timer 382 will activate the ERV 7*c* to draw in make-up supply air for a period proportional to that timed by the timer 382. If a request to turn on the motor 109 is received within the delay period, for example 15 minutes, then the timer will accumulate additional time for activation of the ERV 7*c*. This provides time-shifted pressure balancing.

In general, the amount of air removed by the central vacuum cleaning system is matched by make-up supply air from the ERV 7*c* to provide pressure balancing for the structure. For a simple embodiment, an assumption may be made that a vacuum cleaning system will exhaust approximately half the air as the ERV 7*c* supplies; so that, the ERV 7*c* can be run for approximately 30 secs for each minute that the vacuum cleaning system was running. If desired, an additional percentage of time can be added to make up for other exhaust loads in the structure, such as exhausts fans that are not directly connected to the ERV. Central vacuum systems exhaust air at one rate, while an ERV 7*c* will supply air at a different rate. Empirical tests can be performed generally for cleaning systems and ERVs 7*c* to determine what proportion is generally desirable.

Most residential central vacuum cleaning systems will exhaust air at a similar rate limited by the size of the motor 109 and the system piping. Thus, the more significant variable may be the ERV 7*c* specifications. Thus, it may be beneficial for the manufacturer (who is aware of its ERV specifications) to provide the timing settings for the timer 382.

For sophisticated control it may be desirable to measure the air flow of the ERV make-up supply in situ and match that for the desired timing. Various air flow measurement devices are known in the art.

In order to provide specifications on which timer delay and thresholds can be based, or the timer delay and thresholds, the ERV control module 303 can store these in non-volatile memory 302.

The timer settings could also be input directly by the user 111 at the interface 113 and transmitted from the remote control module 105 for reception at the transceiver 372, decoding by the transceiver subcontrol 374 and storage in memory 302. The memory 302 can be a rewriteable device such as, for example, an EEPROM, EPROM or flash memory device. Alternatively, the settings can be pre-configured in memory 302 by an installer, or at the time of manufacture. If the settings are input at the time of manufacture or installation then a write once memory device, such as a PROM, could be used, if desired.

The module 303 can also include components to sense operating conditions of the motors 309 and provide messages to the user 111 through the user interface 113.

Figure 10:
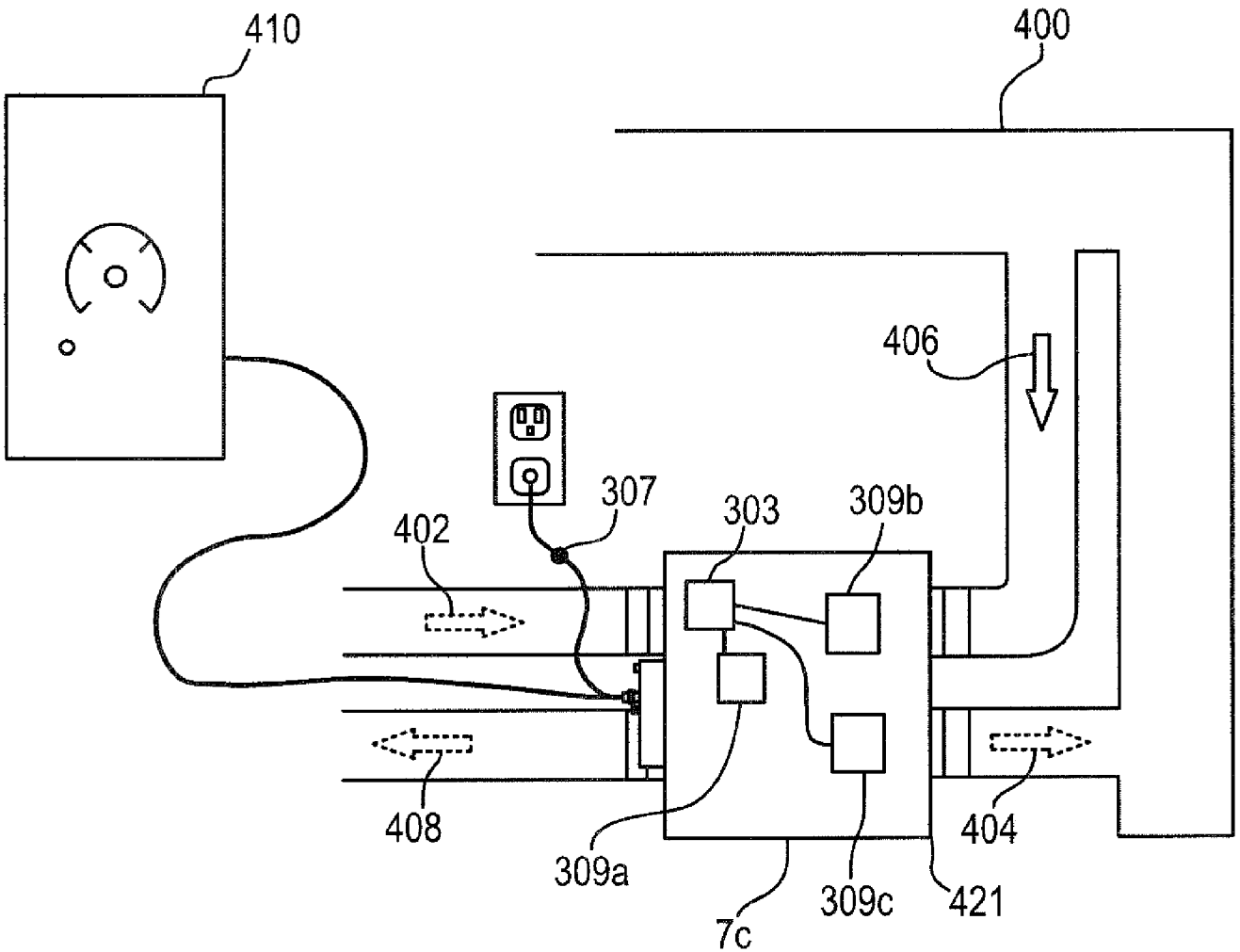
FIG. 10 is a schematic diagram of a preferred embodiment of an installed ERV in accordance with a preferred embodiment of the present inventions and incorporating the ERV control module of FIG. 9.

Referring to FIG. 10, an ERV 7*c* is shown, as an example, installed in conjunction with forced air ductwork 400 of a structure. The ERV 7*c* draws in supply (fresh) air to the structure at 402 and provides that air to the ductwork 400 at 404. The ERV 7*c* is also capable of removing exhaust air from the ductwork 400 at 406 and exhausting that air from the structure at 408. The ERV control module 303 controls the exhaustion and supply of air by the ERV 7*c*. A typical wired wall control 410 and power source 307 are also shown.

As will be evident to those skilled in the art, the ERV 7*c* can be installed in alternative configuration, for example, with its own dedicated ductwork.

ERVs 7*c* can be implemented in many ways. Examples include cross flow plate core, counter flow flat-plate core, heat pipe core, and rotary wheel core. Rotary wheel core implementations can be implemented in configurations to regulate humidity in addition to providing air balancing. It is understood that the principles described herein apply to all types of heat exchangers; although, some features may not be available in all cases, and implementation may require adaptation for different configurations.

Different motors 309 and, possibly, numbers of motors 309 may be used for different configurations of ERVs. For example, a three motor configuration may utilize one motor 309*a* to drive a rotary wheel, while a second motor 309*b* drives an exhaust air blower, and a third motor 309*c* drives a supply air blower. Alternatively, a first motor 309*a* may drive a blower to draw air through the ERV 7*c*, while a second motor 309*b* drives a damper controlling the amount of exhaust air, and a third motor 309*c* drives a damper controlling the amount of supply air.

In order to provide make-up supply air the module 303 activates the motor 309*a* and only the motor 309*c* to supply air, or activates the motors 309*b* and 309*c* in such a way as to provide a greater amount of supply air to the structure than is exhausted. If the motors 309*b* and 309*c* are blower motors then the motor 309*b* may be driven at a slower speed than the motor 309*c*. If the motors 309*b*, 309*c* are damper motors then the motors will drive the dampers to relative positions that provide more supply air than exhaust air.

The motors 309 are controlled by an ERV module subcontrol 394 of the module 303. The subcontrol 394 may contain power stages, not shown, as necessary for driving the motors 309. The subcontrol 394 will act in accordance with signals received from the timer 382. Preferably the subcontrol 394 incorporates a microprocessor acting under instructions stored in memory 303 to control the motors 309 directly, or through the power stages.

Figure 11:
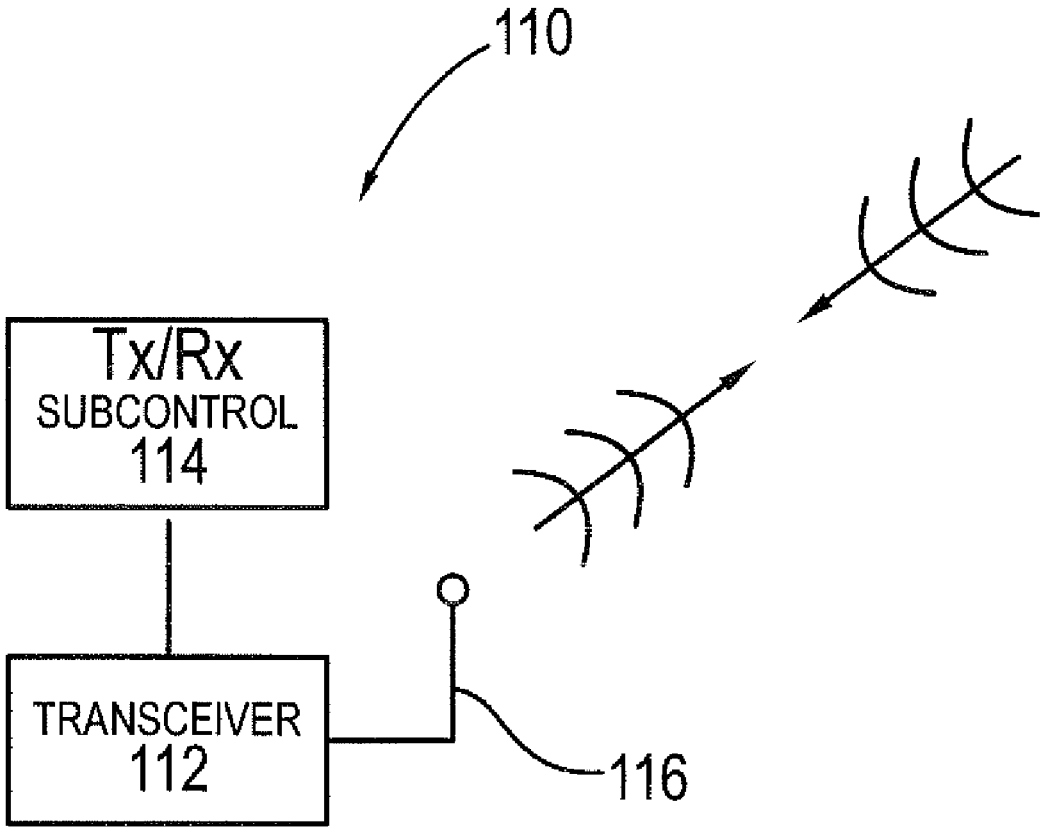
FIG. 11 is a block diagram of a remote transceiver submodule for use in the central vacuum cleaning system subsystem of FIG. 2.

Referring to FIG. 11, remote control module 105 incorporates a remote transceiver submodule 110 similar to that of the central transceiver submodule 72, including a remote transceiver 112, remote transceiver subcontrol 114, and antenna 116. The operation of the remote transceiver submodule 110 and central transceiver submodule 72 are similar and will not be repeated. It is to be noted that the functions of the remote transceiver submodule 110 could be replace by a separate transmitter submodule and/or receiver submodule, not shown.

In the preferred embodiment, the transceiver submodules 72, 110 of central control module 103 and remote control module 105, respectively, are matched for transmission and reception of signals over a distance of approximately 150 ft. through typical residential obstacles and building materials. The design distance is a matter of choice, governed by applicable legal requirements such as might apply to signal strength and frequency. A digitally modulated radio frequency (r.f.) carrier of 433.92 MHz is suitable as it meets current North American and European requirements for r.f. control systems.

Alternatively, r.f. transmissions can operate in spread-spectrum mode. This could include frequency hopping spread spectrum or direct-sequence spread spectrum (DSS). These techniques enable operation at higher r.f. power levels than single frequency operation by distributing the power over a number of different frequency channels. In this case, the carrier frequency could be in the 850-950 MHz or 2.4 GHz bands to comply with legal requirements in North America and Europe. In this case, design for a minimum distance of approximately 300 ft. between central control module 103 and remote control module 105 is preferred.

Other r.f. transmission techniques and frequencies could be used as desired for particular applications.

A microprocessor can be used as the transceiver subcontrol 114 in the remote control module 105 to provide the digital encoding of r.f. carrier with message data, and to decode messages received from the central control module 103. Other devices such as a microcontroller or discrete components could be used to perform these functions.

Wireless communication provides a significant advantage. Wired low voltage signals require a step down transformer from line voltage to low voltage, such as a class H safety transformer. Wireless communication obviates the need for low voltage signals and the class II transformer for that purpose.

The central control module 103 can be powered using a drop down resistor or capacitor from the power source 109. A non-class II transformer can be used in the event that larger power is required as wireless communication does not require the use of a class II transformer. It may still be desired to use a class II transformer in order to allow a manufacturer to provide an option to communicate via low voltage wires connected between the central control module 103 and the remote control module 105. The selection between wired and wireless communication can be made at the time of manufacture, or the manufacturer can leave this selection up to the installer. If the selection is made by the manufacturer than separate different central control modules and remote control modules can be made for wired and wireless configurations.

It is to be understood that wireless communication is not required for all of the functions described herein. In fact, for many functions it is not necessary to have communication between the user 111 and the central vacuum source 205, except to turn the motor 109 on and off. The other functions can operate without user intervention.

Figure 12:
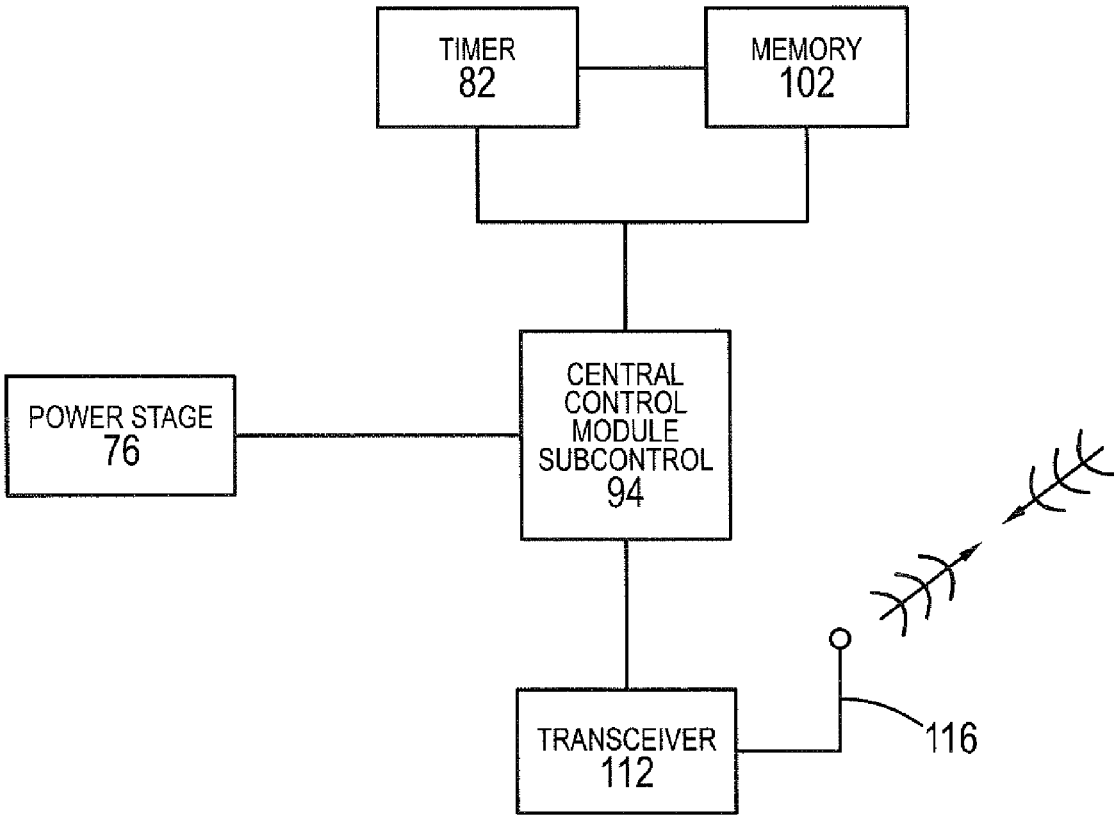
FIG. 12 is a detailed block diagram of an ERV submodule for use in the ERV system subsystem of FIG. 2.

Referring to FIG. 12, the various submodules of the central control module 103 can be combined. In combining the submodules, the various subcontrols can also be combined into a single central control subcontrol 94 which can utilize a single microprocessor, microcontroller or combination of discrete components, to perform the functions described herein for each of the submodules. The memory 102 can be part of the microprocessor or microcontroller, or it may itself be a discrete component. Preferably, the central control subcontrol is a microprocessor with integrated memory 102. The entire timer submodule may be part of the microprocessor, or it may be a combination of the microprocessor and a few discrete components to set the proper timing for the timer. Alternatively, the timer may comprise components discrete from the microprocessor.

The various subcontrols, microprocessor and microcontroller are programmed to perform the functions described herein. The programs are contained in a non-volatile memory, such as memory 102, or an internal memory within the sub-control, microprocessor or microcontroller.

Control signals, such as ON/OFF, from the operator 111 are provided through a switch 123 (or switches 123 or some other interface 113 in the handle 29. More sophisticated systems may utilize the control signals for many other purposes, such as duplex communications that allow the receipt of information at the handle 29. Such information could be used to drive LEDs or other display means (as described previously for the interface 113) for communication with the operator 111. When the operator 11 turns on the system 1, dirt is drawn by a vacuum created by the vacuum source 27 through attachment 216, handle 29, hose 211, and pipes 207.

Figure 13:
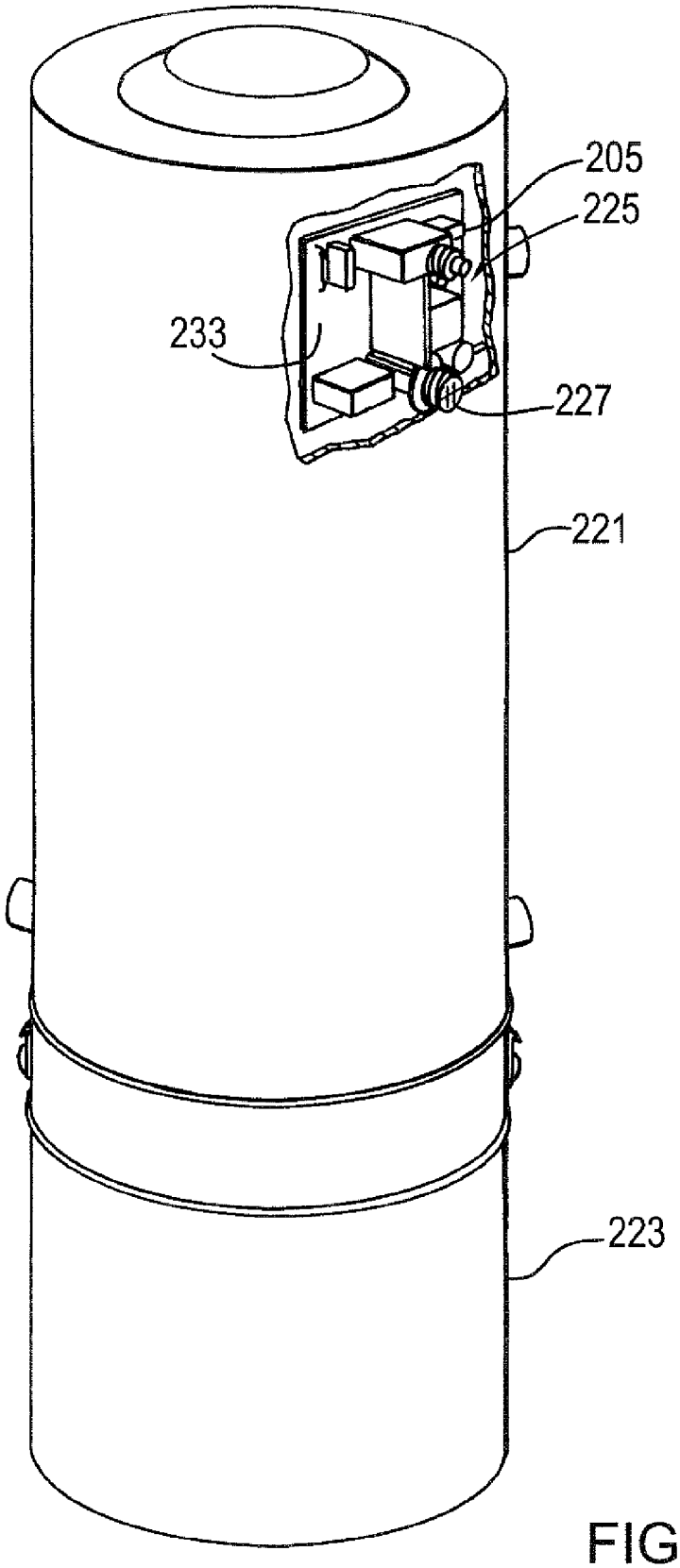
FIG. 13 is a cut-away perspective view of a vacuum source for use in the cleaning system of FIG. 1.

Referring to FIG. 13, the vacuum source 205 has a motor 109 (FIG. 1) within a motor housing 221. Extending from the motor housing 221 is, typically, a receptacle 223 for receiving the dirt. Also within the motor housing 221 is a motor control circuit 225 embodying central control module 103 of FIG. 2. In the preferred embodiment, the motor housing 221 also acts as a motor control housing 221. Accordingly, the motor housing 221 will be referred to as a motor control housing herein, unless the context requires otherwise. It is to be understood that the motor housing and motor control housing could be separate from one another.

Preferably, the central control module 103 (including its transceiver 74) is placed within the motor control housing 221. Alternatively, the central control module 103 could be distributed with the transreceiver 74 portion outside the motor housing 221 to avoid interference and signal attenuation.

The motor control circuit 225 is typically laid out on a printed circuit board 233, including all of the components to implement the functions of the central control module 103. Multiple printed circuit boards or separately mounted components may be used as desired.

The motor control circuit 225 can be mounted in many different ways, for example on mounting screws or posts, not shown, inside or outside the motor control housing. It may be preferable to mount the motor control circuit 225 in the cooling air inlet passage or outtake (exhaust) of the motor 109 to provide cooling for the circuit 225. Any power stage of the circuit 225, in particular, may benefit from such cooling.

Although the preferred embodiment is being described with reference to a motor control circuit 225 for mounting inside a motor housing 221, as mentioned previously, the circuit 225 need not be mounted inside the motor housing 221. For example, the circuit 225 could be mounted within a control box, not shown, outside the housing 221 with wires fed back into the housing 221 for operation of the motor 109. This might be done for additional isolation of the control circuit 225 from the motor 109. For example, it might be helpful to avoid electromagnetic interference from the motor 109. The control box would be an alternate form of motor control housing 221. As mentioned previously, for this reason, the motor housing 221 is being referred to as a motor control housing 221 in this description, unless the context requires otherwise.

In the preferred embodiment, the central control module 103 also has means for communication with the operator 111. In the preferred embodiment, display means 75 takes the form of an LED, not shown, within a translucent mounting post 227. The motor control circuit 225 has optional wired and wireless communication paths. Accordingly, the mounting post 227 accepts connections from low voltage wires. As an alternative display example, the LED could extend through the housing 221 for direct viewing.

LEDs are a preferred choice as LEDs are long lasting, small, inexpensive, and low power devices. Higher power LEDs, LEDs of different colours, multi-colour LEDs, and LEDs of different shapes and sizes may all be used. Standard LED packages such as a T-1 or T-1¾ can be used. These tend to be the least expensive. This allows for LEDs of more than 3000 mcd, for example 3200 mcd and 4500 mcd in green. These are examples only and many other sizes and configurations can be used. For example, a multi-colour LED could be used to provide many possible signaling combinations, such as a red/yellow LED that can provide red solid, red flashing, yellow solid, yellow flashing, orange solid, and orange flashing. Also, single colour LEDs can be chosen from a wide variety of colours, including green, yellow, red, white and blue, among others.

The messages provided to the user 111 by the LEDs might include, for example, 1) informing the user that electrical power is present and the system 1 has no apparent problems (LED GREEN), 2) air flow is obstructed, check for obstructions, including in the pipes 207, in the flexible hose 211 or the filter medium, or the dust receptacle 223 is full and should be emptied (LED YELLOW), 3) a sensor indicates that service to the system 201 is needed, for example, an overcurrent condition shutdown that may indicate a problem such as bearing failure (LED flashes RED), and 4 a certain amount of time has passed indicating that service to the system 201 is needed, for example: service to the motor is required, i.e. change the brushes (LED flashes YELLOW). These are samples of the types of messages that might be conveyed to the user. Many other messages could be conveyed as desired by designers of motor control circuit 225 using other colours or flashing patterns.

Referring again to FIG. 10, preferably, the ERV control module 303 (including its transceiver 374) is placed within an ERV control housing 421. Alternatively, the ERV control module 303 could be distributed with the transreceiver 374 portion outside the housing 421 to avoid interference and signal attenuation.

An ERV control circuit, not shown, is typically laid out on a printed circuit board, including all of the components to implement the functions of the ERV control module 303. Multiple printed circuit boards or separately mounted components may be used as desired.

The ERV control circuit can be mounted in many different ways, for example on mounting screws or posts, not shown, inside or outside the ERV housing 421. It may be preferable to mount the ERV control circuit in the exhaust air path of the ERV 7*c* to provide cooling for the circuit. Any power stage of the circuit, in particular, may benefit from such cooling.

Although the preferred embodiment is being described with reference to an ERV control circuit for mounting inside a housing 421, as mentioned previously, the circuit need not be mounted inside the housing 421. For example, the circuit could be mounted within a control box, not shown, outside the housing 421 with wires fed back into the housing 421 for operation of the motors 309. This might be done for additional isolation of the control circuit from the motor 309. For example, it might be helpful to avoid electromagnetic interference from the motor 309. The control box would be an alternate form of ERV control housing 421. As mentioned previously, for this reason, the ERV housing 421 is being referred to as a motor control housing 421 in this description, unless the context requires otherwise.

Figure 14:
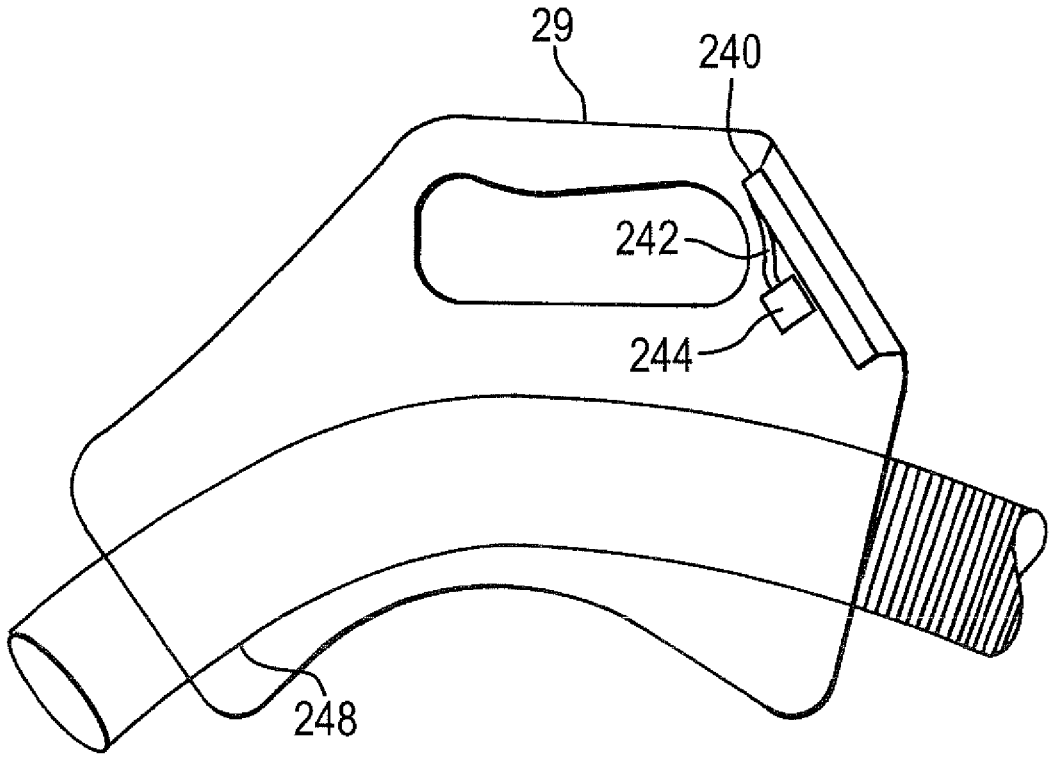
FIG. 14 is a cross-section of a hose handle incorporating a remote control module in accordance with a preferred embodiment of the present invention.

Referring to FIG. 14, in a manner similar to that described for the central control module 103, the remote control module 105 is mounted in a handle, for example handle 29, typically on a printed circuit board 240. It is to be noted that other handles, such as for example handles 200, 213 could be used. The printed circuit board 240 and other components of the central control module 103 could be fully encapsulated with simply a couple of wires 242 extending for connection to a power source 244. Messages are provided to the user 111 in the manner described previously herein. The messages provided to the user 111 include, for example, those previously described for the central control module 103.

The remote control module 105 is preferably battery 244 powered; however, it may also be powered from line voltage where it is available, using a drop down resistor and capacitor. Many vacuum hoses 217 have line voltage as it is used to power hose attachments 216, such as a power carpet brush. The battery 244 could be a rechargeable battery 244. Batteries 244 provide energy for limited durations.

In this description an embodiment has been described wherein the central control module for the central vacuum unit interacts with an ERV to provide pressure balancing of a structure. Another embodiment has been described wherein a remote control module interacts with a central vacuum unit and with an ERV to provide pressure balancing. It is to be understood that structure from one embodiment may be transferred to the other embodiment to provide corresponding features.

In this description an embodiment has been described wherein an ERV control module contains structure providing intelligent control of the ERV following external input, for example using a timer that is activated on receipt of an external signal. It is to be recognized this intelligence could be in the remote control module 105, such that, the remote control module calculates the relevant time and simply instructs the ERV to turn on and off, or on for certain period of time, in a mode that will provide make-up supply air. For example, it is recognized that some ERVs provide an offset mode that will provide make-up supply air. An example is the RecoupAerator™ 200DX energy recovery ventilator of UltimateAir™ Inc. of Athens, Ohio. This model provides a jumper connect to determine the offset; however, the jumper could be replaced with a controllable setting, such as through a microprocessor to allow selective activation of the offset, including an offset of zero for a balanced mode. Such a controllable setting could be utilized by any of the embodiments described herein.

Similarly, the intelligence could be in the central control module 103 and activated when the central vacuum is activated. As a further alternative, the intelligence could be distributed across the central vacuum hose handle 29, the ERV 7*c* and the central vacuum source unit 41.

Referring again to FIG. 1, a blower (such as a fan) 500 can replace the ERV 7*c* as an external air intake device. The blower 500 may be within an area 502 (for example a garage or utility room) of the structure 9 that is not in air connection to the area 504 (for example an upper floor room) being vacuumed at the time of air replenishment. If so, the blower 500 can be connected to the forced air ductwork 400 in a similar manner to that described for the blower 309*c* of FIG. 10. The blower 500 can then be controlled in a manner similar to the blower 309*c*, for example utilizing an appliance communication module 5 similar to that described for use in association with the ERV 7*c*. Again, it is to be recognized that the control could be through a wired connection to the blower 500. The control intelligence could be at the blower 500 or in the central vacuum system as discuss previously.

The blower 500 may also be located in an area 506 that is in air communication with the area 502 being vacuumed, for example another room in a main part of the structure 9. In this case, a simple air replenishment system may be implemented without ductwork 400 by simply allowing make-up air from the blower 500 to flow into the area 506 directly. Air pressure in the structure 9 then equalizes on its own. Air connection for pressure equalization within the structure 9 may also occur through air connection provided by operation of any air handling equipment in the structure 9 and associated ductwork that is in air connection with areas 502, 506. Although it is preferable that the areas 506, 502 are in air contact at the time that make-up air is drawn into the structure 9, this can be allowed to occur at a later time, for example when doors are opened between the areas 502, 506.

Similarly, the blower 500 can be replaced by an air intake device 600 that utilizes pressure differential to draw in make-up air to the structure 9. Such a device 600 is, for example, a damper 600 that opens and closes air connection between internal and external air for the structure 9. After use of the central vacuuming system, the damper 600 can be open to allow pressure equalization between internal and external air. The damper 600 will need to be located in an area 506 that is in air connection with the vacuumed area 502 in order for any lower pressure in the area 502 to draw in make-up air through the open damper 600, for example utilizing an appliance communication module 5 similar to that described for use in association with the ERV 7*c*. Again, it is to be recognized that the control could be through a wired connection to the damper 600. Again, operation of the damper 600 can be controlled in a manner similar to that of the blower 309*c*.The control intelligence could be at the damper 600 or in the central vacuum system as discuss previously. The damper 600 may, as an example, take the form of a motorized flap.

It is to be recognized that each of the example embodiments for intake of supply air include air intake devices, for example the ERV 7*c*, the blower 500 and the damper 600 are all air intake devices.

It is to be recognized that although this description is made with reference to central vacuum cleaning systems, many of the functions will also apply to portable vacuum cleaning systems such as canister vacuum cleaners and upright vacuum cleaners as will be evident to those skilled in the art. It is recognized that the pressure balancing embodiments of the description are unlikely to be applied to non-central vacuum applications as air is not typically exhausted in those applications. In many central vacuum cleaner system installations air is not exhausted from the structure, but to an area of the structure outside of the main living space, for example to an attached garage where the central vacuum source in located. Make-up air to the structure for the main living space can still be beneficial in these installations.

It will be understood by those skilled in the art that this description is made with reference to the preferred embodiment and that it is possible to make other embodiments employing the principles of the invention which fall within its spirit and scope as defined by the following claims.

I claim:

1. A vacuum cleaning system for use in a structure, the system comprising:

a) a receiver adapted to receive communication that an appliance has been activated, and b) a control circuit adapted to turn off the central vacuum cleaning system upon receipt of a communication at the receiver that the appliance has been activated, wherein the appliance is a telephone and the telephone is activated when there is an incoming call on the telephone.

2. The system of claim 1 wherein the control circuit is adapted to turn off the cleaning system when there is an incoming telephone call.

3. The system of claim 1 further comprising an adapter adapted to sense activation of the appliance and transmit a communication to the receiver.

4. The system of claim 3 wherein the adapter is a telephone line adaptor adapted to sense incoming calls on the telephone line.

5. The system of claim 1 wherein the receiver is a wireless radio frequency receiver and the communications are wireless radio frequency communicators.

6. A vacuum cleaning system for use in a structure, the system comprising:

a) a receiver adapted to receive communication that an appliance has been activated, and b) a control circuit adapted to turn off the central vacuum cleaning system upon receipt of a communication at the receiver that the appliance has been activated, wherein the appliance is a doorbell.

7. The system of claim 6 wherein the control circuit is adapted to turn off the cleaning system when the doorbell is activated.

8. The system of claim 6 further comprising an adapter adapted to sense activation of the appliance and transmit a communication to the receiver.

9. The system of claim 6 wherein the receiver is a wireless radio frequency receiver and the communications are wireless radio frequency communicators.

10. A method of controlling a central vacuum cleaning system comprising:

receiving communications at the central vacuum cleaning system when there is an incoming telephone call to a telephone, and controlling the central vacuum cleaning system to turn off the system upon receipt of the communications.

11. The system of claim 8 wherein the adapter is a doorbell adapter adapted to sense activation of the doorbell.

12. A method of controlling a central vacuum cleaning system comprising:

receiving communications at the central vacuum cleaning system when a doorbell is activated, and controlling the central vacuum cleaning system to turn off the system upon receipt of the communications.

* * * * *